US006790315B2

(12) United States Patent
Klerelid

(10) Patent No.: US 6,790,315 B2
(45) Date of Patent: Sep. 14, 2004

(54) DRYING SECTION AND METHOD FOR DRYING A PAPER WEB

(75) Inventor: Ingvar Klerelid, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 137 days.

(21) Appl. No.: 10/213,962

(22) Filed: Aug. 7, 2002

(65) Prior Publication Data

US 2002/0179269 A1 Dec. 5, 2002

Related U.S. Application Data

(63) Continuation-in-part of application No. 09/596,000, filed on Jun. 16, 2000, now Pat. No. 6,488,816.
(60) Provisional application No. 60/141,683, filed on Jun. 30, 1999.

(30) Foreign Application Priority Data

Jun. 17, 1999 (SE) ..... 9902319

(51) Int. Cl.[7] ..... D21F 5/00; D21F 11/00; D21F 3/00

(52) U.S. Cl. ..... 162/117; 162/109; 162/207; 162/359.1; 162/358.3; 162/361; 162/358.5; 162/296; 34/400; 34/111; 34/132; 34/618; 34/236

(58) Field of Search ..... 162/109, 117, 162/204–207, 359.1, 358.1, 358.3, 358.5, 361, 296; 34/108, 111, 114, 132, 143, 611, 618, 619, 397–400

(56) References Cited

U.S. PATENT DOCUMENTS

| | | | |
|---|---|---|---|
| 1,883,526 A | 10/1932 | Bryan | |
| 3,198,695 A | 8/1965 | Justus | |
| 3,981,084 A | 9/1976 | Sobota | |
| 4,144,124 A | 3/1979 | Turunen et al. | |

(List continued on next page.)

FOREIGN PATENT DOCUMENTS

| | | |
|---|---|---|
| DE | 43 21 403 A1 | 1/1994 |
| DE | 196 54 345 A1 | 6/1998 |
| EP | 0490655 A1 | 6/1992 |
| WO | WO 93/23613 A1 | 11/1993 |
| WO | WO 93/23614 | 11/1993 |
| WO | WO 98/55691 A1 | 12/1998 |
| WO | WO 00/79046 A1 | 12/2000 |

OTHER PUBLICATIONS

Copy of PCT International Search Report for PCT Application PCT/SE 03/01240, filed Jul. 24, 2003, Completion Date of Search Report Oct. 6, 2003 (Mailed Oct. 16, 2003).

*Primary Examiner*—José A Fortuna
(74) *Attorney, Agent, or Firm*—Alston & Bird LLP

(57) ABSTRACT

A drying section for drying a web in a papermaking machine has a pre-drying section and a final drying section, wherein the pre-drying section includes a hot press formed by a first press member and a rotatable counter roll in engagement with each other so as to form a nip therebetween through which the web passes. The hot press further includes a heating device disposed in heat-transfer relation to the counter roll and operable to heat a surface region of the counter roll which then passes through the nip so as to heat the web therein, and an imprinting fabric arranged in an endless loop, the imprinting fabric defining an imprinting surface for imprinting the web and being arranged to pass through the nip of the hot press with the web against the imprinting surface such that the web is imprinted. The imprinting fabric continues to support the imprinted web downstream of the hot press at least up to the final drying section.

27 Claims, 5 Drawing Sheets

U.S. PATENT DOCUMENTS 4,302,282 A * 11/1981 Young ..... 162/111
4,309,246 A 1/1982 Hulit et al.
4,324,613 A 4/1982 Wahren
4,356,059 A * 10/1982 Hostetler ..... 162/111
4,420,372 A * 12/1983 Hostetler ..... 162/280
4,720,325 A 1/1988 Rausing et al.
5,393,384 A 2/1995 Steiner et al.
5,439,559 A 8/1995 Crouse
5,556,511 A 9/1996 Bluhm et al.
5,701,682 A 12/1997 Chuang et al.
5,776,307 A 7/1998 Ampulski et al.
5,795,440 A 8/1998 Ampulski et al.
5,855,739 A 1/1999 Ampulski et al.
5,904,811 A * 5/1999 Ampulski et al. ..... 162/117
5,935,381 A 8/1999 Trokhan et al.
6,051,105 A 4/2000 Ampulski
6,182,375 B1 2/2001 Banerjee
6,210,528 B1 * 4/2001 Wolkowicz ..... 162/111
6,221,214 B1 4/2001 Kotitschke et al.
6,379,496 B2 * 4/2002 Edwards et al. ..... 162/111
6,398,909 B1 * 6/2002 Klerelid ..... 162/109
6,423,186 B1 * 7/2002 Trokhan et al. ..... 162/280
6,458,248 B1 * 10/2002 Edwards et al. ..... 162/361
6,488,816 B1 * 12/2002 Klerelid ..... 162/359.1
6,517,672 B2 * 2/2003 Edwards et al. ..... 162/109
6,669,821 B2 * 12/2003 Edwards et al. ..... 162/358.1
2002/0060046 A1 * 5/2002 Scherb et al. ..... 162/358.1
2002/0179264 A1 * 12/2002 Phan et al. ..... 162/109
2002/0179269 A1 * 12/2002 Klerelid ..... 162/206
2003/0116292 A1 * 6/2003 Hollmark ..... 162/132

* cited by examiner

DRYING SECTION AND METHOD FOR DRYING A PAPER WEB

CROSS-REFERENCE TO RELATED APPLICATIONS

This application is a continuation-in-part of U.S. patent application Ser. No. 09/596,000 filed Jun. 16, 2000, now U.S. Pat. No. 6,488,816 B1, which is incorporated herein by reference and which claims the benefit of U.S. Provisional Patent Application Serial No. 60/141,683, filed Jun. 30, 1999, and Swedish Patent Application No. 9902319-4 filed Jun. 17, 1999.

FIELD OF THE INVENTION

The present invention relates to apparatus and methods for drying a continuous tissue paper web in a papermaking machine. The invention relates more particularly to a drying section and method in which the web is passed through a pre-drying section and a final drying section, wherein the pre-drying section has at least one press that includes a first press device and a counter roll arranged in contact with each other so as to form a press nip therebetween, and an endless fabric is arranged to pass through the press nip together with the web.

The term "tissue" as used herein is intended to include all kinds of soft hygiene paper, whether creped or not, including but not limited to handkerchief paper, bathroom tissue, and towel.

BACKGROUND OF THE INVENTION

In the production of soft paper or tissue at lower basis weights, which is used for the production of household paper such as paper towels and other sanitary products, it is a general requirement that the bulk, i.e., the ratio between the volume and the weight of the paper, should be substantially higher than for other types of paper. Paper with a high bulk exhibits a desired combination of softness and high water absorption capacity.

The present commercially used technology to dry a continuous tissue web in a drying section employs large-diameter cylinders, so-called Yankee dryers, which are steam heated internally, or employs porous cylinders (so-called TAD cylinders) on which thermal through-air drying of the web is performed by blowing hot air through the web, either outwardly from the inside of the cylinder or inwardly from the outside of the cylinder.

Use of Yankee dryers for drying tissue has a major disadvantage in that the smooth surface of the cylinder causes the web to be compressed as it is pressed onto the Yankee dryer by means of a press roll, which is wrapped by a felt that carries the web to the Yankee dryer. This is especially the case since the web generally is still relatively wet when it is transferred to the Yankee dryer, leading to its structure and bulkiness being impaired by the treatment on the Yankee dryer. Hence, in a conventional drying section for tissue, only limited bulk levels can be reached. Typically, the web is creped from the Yankee dryer in order to somewhat improve its softness and bulkiness, but generally that improvement is lost when the tissue is used and thereby becomes wet.

In the development of drying sections for tissue, it has also been suggested to partially dewater the web in a press section comprising one or more press nips, possibly of shoe press type, before finally drying the web on a conventional drying cylinder such as a Yankee dryer. A papermaking machine of this type, including a pre-drying section and a final drying section, is disclosed in U.S. Pat. No. 5,393,384, the web being carried by an impermeable belt through the drying sections. Although a certain beneficial effect results from this type of system, the press section cannot be made adequately efficient, since only limited linear loads can be used in the press nips in order to avoid compressing the tissue web and thereby reducing the bulk of the web. Consequently, one press is usually not sufficient to reach the desired dry content levels in the press section, and hence at least two presses have to be used, which requires more space, investment costs, and energy. Despite using at least two presses, the resulting tissue becomes relatively flat and compact, with a bulk that is lower than the desired high bulk. Another problem with the use of such presses is that rewetting of the web at the outlet from the press nip usually occurs, which reduces the effectiveness of the press in dewatering the web.

Drastically improved bulk levels have been reached by the use of thermal through-air drying cylinders, i.e., TAD cylinders. Typically, the bulk is increased by about 60 to 200%, compared to the bulk levels that are reached with a conventional press nip followed by a Yankee dryer. Usually, the TAD cylinder is preceded by a suction apparatus, by which an imprinting pattern is achieved in the web in its wet state. The web is thereafter dried in the TAD cylinder, by inward or outward air flow, while retaining the structure of the imprinting pattern and thereby retaining the high bulk of the web. In the TAD drying, the imprinted web structure is, in a matter of speaking, frozen in its structure.

The TAD cylinder, however, has the disadvantages that it requires a lot of space, has a limited capacity, and yet requires a lot of energy. Moreover, the TAD cylinder requires the use of very large air volumes that have to be handled. Also it entails high investment costs.

Another known method to dry a fibrous web is to use so-called impulse drying. The wet web is pressed at a high temperature and with a high linear load in a press section comprising one or more press nips. The technique is described in SE 7803672-0, corresponding to U.S. Pat. No. 4,324,613, and is used in web types other than tissue webs, or for tissue webs with limited bulk. In these patents, there are described maximum specific pressures of 3–8 MPa and surface temperatures on the counter roll of a press of conventional type of between about 150° C. and 350° C. By "conventional type" is meant a press nip in which two rolls with cylindrical cross sections are counter-acting against each other under pressure. The time that a given region of the moving web resides in this type of press nip, however, is only a few milliseconds because of the short length of the press nip in the machine direction, which is too short a time for the beneficial effects of the high pressure acting at a high temperature to be fully developed. Therefore, it has also been suggested to use impulse drying in a heated shoe press in which the press nip is extended to about 20–30 cm, giving much longer residence times for the web in the nip.

U.S. Pat. No. 5,556,551 discloses such an impulse drying process for drying paper webs such as toilet paper. The web and a water-absorbing felt are fed into a press nip of a shoe press. The web may be heated by steam prior to its entry into the nip, or the smooth surface of the counter roll may be heated prior to the nip. Delamination, caused by the sudden expansion of flash steam when the web leaves the high-pressure nip, is said to improve the volume and softness of the web. The dried web is creped from the counter roll by a doctor. High bulk levels cannot be reached by the process of U.S. Pat. No. 5,556,551, since the web will be compressed in the nip between the absorbing felt which has a flat surface and the smooth surface of the counter roll.

Yet another known method to dry tissue web is to use a drying cylinder, such as a Yankee dryer, as the counter roll in a press nip. The roll that co-acts with the counter roll may also be equipped with a press shoe so that an extended nip is formed. Systems of this type are shown in DE 196 54 345 (FIG. 5) and DE 43 21403 (FIG. 11). The press shoe may include a heating device. In U.S. Pat. No. 3,806,406, there is shown a system for the formation of a tissue web, which system also is of the type with a press nip between a first roll and a Yankee dryer. This system seeks to avoid compressing of the high-bulk tissue web by providing the surface of the Yankee dryer with a relief pattern with depressions and elevated parts therebetween. Essentially, only the parts of the web that abut the elevated parts of the cylinder surface are pressed together in the press nip, the intermediate parts being relatively unaffected. The web is thereby provided with an imprinting pattern consisting of parts that are pressed together and other parts that are not pressed together, corresponding to the pattern of the cylinder surface.

Despite several methods, devices and systems being known for drying tissue webs, there is no commercially available drying section that gives a high bulk, high water absorption levels, a good softness, and a distinct imprinting pattern in the web, while also requiring only a relatively small space, entailing relatively low investment and energy costs, and yet having a high capacity and good reliability.

SUMMARY OF THE INVENTION

The above needs are met and other advantages are achieved by the present invention, which provides a drying section for drying a web in a papermaking machine, the drying section comprising a pre-drying section and a final drying section, wherein the pre-drying section includes a hot press formed by a first press member and a rotatable counter roll in engagement with each other so as to form a nip therebetween through which the web passes. The counter roll of the hot press is heated by at least one heating device. In preferred embodiments, the counter roll includes a hollow outer shell, and both internal and external heating devices disposed in heat-transfer relation to the shell are operable to heat the shell to raise the temperature of the web-contacting exterior surface of the shell, which then heats the web while the web is in contact with the exterior surface. An imprinting fabric is arranged in an endless loop, the imprinting fabric defining an imprinting surface for imprinting the web and being arranged to pass through the nip of the hot press with the web against the imprinting surface such that the web is imprinted. The imprinting fabric continues to support the imprinted web downstream of the hot press at least up to the final drying section.

Since the terms "impulse dryer" and "impulse drying" imply that water in the web evaporates so violently that the formed steam blows out liquid water from the web, the more generic terms "hot press" and "hot pressing" are used to describe the present invention.

Preferably, the surface region of the counter roll is arranged to be heated by the heating devices to a temperature of at least 150° C., and more preferably 200–300° C. The external heating element is arranged at a location other than where the web is carried by the counter roll, preferably just ahead of the press nip. The internal heating device can be of various types such as heated fluid arrangements, induction heater arrangements, gas-fired heaters, infrared heaters, or the like.

In one embodiment, the imprinting fabric is arranged to maintain the web against the counter roll over a sector of the counter roll subtending an angle of about 90° to 300°. Accordingly, the web remains in contact with the heated surface of the counter roll for an extended period of time so that the drying of the web is performed for a greater time. The hot press can also include a ventilation hood surrounding at least a portion of the sector of the counter roll wrapped by the web for carrying away steam liberated from the web. Alternatively, the pre-drying section can be arranged to lead the web away from the first press device and the counter roll essentially immediately downstream of the press nip. One advantage of this arrangement is that a higher temperature may be used on the counter roll without risk of the (synthetic) fabric being destroyed.

Preferably, in every location in the drying section where the web is pressed or subjected to a load between two surfaces, such as between the surface of a roll or cylinder and a fabric or clothing, or between two surfaces in a press nip, at least one of said two surfaces exhibits a structured/coarse surface. In the case of the structured/coarse surface being a fabric or a clothing, it preferably is a permeable imprinting fabric or clothing. In the case of the structured/coarse surface being the shell surface of a roll or cylinder, it is a surface with a relief pattern. In this way, the web is never completely compressed between two flat or smooth surfaces in the drying section, whereby it retains a high bulk, a good softness and good water absorption levels, the structure of the web being essentially retained even when it is re-wetted when used.

The first press member can be a cylindrical roll or can include a press shoe forming an extended nip with the counter roll. Preferably, the drying section also includes a clothing operable to carry water away from the web. The clothing is arranged in an endless loop such that the clothing passes through the nip with the imprinting fabric sandwiched between the clothing and the web and then separates from the imprinting fabric and the web downstream of the nip.

The drying section can also include at least one suction device disposed upstream of the nip for suctioning the web against the imprinting surface of the imprinting fabric such that the web is made to conform to the imprinting surface.

The final drying section in some embodiments includes a heated dryer roll, and the imprinting fabric loop includes a guide roll that forms a nip with the heated dryer roll through which the imprinting fabric with the web supported thereon passes. The web is transferred from the imprinting fabric onto the heated dryer roll at the nip, and the web is then carried about the heated dryer roll for final drying of the web. Since the web is pressed onto the heated dryer roll by the imprinting fabric, the web is not compressed between two smooth surfaces, and hence the imprinted web is finally dried in its imprinted condition, which tends to lock the imprinted structure into the web so that it remains even upon re-wetting of the web.

In other embodiments, the final drying section includes a rotary through-air dryer having a drying cylinder about which the imprinting fabric is wrapped so as to carry the web about the drying cylinder. In yet other embodiments of the invention, the final drying section includes a rotary through-air dryer having a drying cylinder and further includes a drying fabric arranged in an endless loop so as to pass over the drying cylinder. The imprinting fabric loop is arranged to transfer the web from the imprinting fabric onto the drying fabric upstream of the drying cylinder, and the drying fabric carries the web about the drying cylinder.

In some embodiments, the counter roll may be a solid cylindrical body, or may comprise a heatable, rotatable sleeve that surrounds a rotatable roll body. A region of the exterior cylindrical surface of the sleeve is heated by an external heating element. The sleeve preferably loosely surrounds the roll body in order to allow free expansion of the sleeve in relation to the roll body as the sleeve is heated. The sleeve and the roll body are eccentrically arranged in relation to each other such that the sleeve is in contact with the first press device in the press nip and also is in contact with the roll body in the press nip, so that a linear load is conveyed from the roll body to the nip via the sleeve. The rotation of the sleeve is driven by the rotation of the roll body, the friction between the roll body end the sleeve forcing the sleeve to rotate with the same peripheral speed as the roll body. By this construction, temperature-related stress in the counter roll is substantially avoided. Such stress may occur with a solid cylindrical counter roll because the outer layer of the roll becomes hotter than the inner layers of the roll, and hence the outer layer will expand more than the inner layer, resulting in temperature-induced stresses. Also, with a solid roll it may be difficult to maintain the desired geometrical shape of the roll across the machine direction because of difficulties in maintaining the same temperature in the shell surface as in the roll heads. With a sleeve that is loosely arranged around the roll body, these types of problems are avoided. Another advantage with the exchangeable sleeve is that the imprinting pattern may be changed relatively simply, by changing sleeves.

However, as noted, in preferred embodiments of the invention the counter roll has a hollow cylindrical shell, and an internal heating arrangement is used in addition to the external heating device. The internal heating arrangement in one embodiment comprises a plurality of fluid-carrying members arranged in proximity to the inner surface of the shell for carrying heated fluid to heat the shell. In another embodiment, a series of induction coils are disposed inside the hollow shell to heat the shell inductively. It is particularly efficient to heat the shell both internally and externally, and such heating also gives better spatial uniformity of temperature of the shell exterior surface compared to external heating alone. Other known types of heated rolls can also be used instead of the fluid- or induction-heated rolls.

Preferably, the hot press is arranged to provide an outgoing dry content of 40–60%, and more preferably 45–55%, in the web, when the incoming web to the press has a dry content of 10–30%, and more preferably 20–30%. Accordingly, the dry content of the web is raised 10–50% in the hot press nip. Although not preferred, it is possible to use more than one press nip in the pre-drying section, the additional press nip(s) being of conventional wet press type or of impulse drying type.

The press nip is preferably arranged to provide a linear load of 20–400 kN/m, and more preferably 40–120 kN/m, between the first press device and the counter roll. The counter roll may have a smooth surface, at least if the fabric that carries the web through the nip has a structured, imprinting surface. Alternatively, the shell surface of the counter roll may have a patterned, imprinting surface, with depressions with a depth of preferably 0.1–2.0 mm, and parts between the depressions, i.e. elevated parts, preferably having a width of 1–5 mm. The surface area of the elevated parts, i.e. the surface area which will be in contact with the web, constitutes 20–50% of the total surface area of the shell surface, measured at the circumference of the shell. If both the permeable fabric and the counter roll are provided with imprinting patterns, the tissue product will beneficially be imprinted on both sides. Preferably, the counter roll has a diameter of 2.0–3.6 m.

According to another aspect of the invention, pressurized air knives, doctor blades, or the like are arranged to release the web from the surface of the counter roll.

By the combination, according to the invention, of a pre-drying section based on hot pressing technique and a final drying section that may include a drying cylinder such as a Yankee dryer or a TAD cylinder or other drying means known in the art, and with the web never being compressed between two flat or smooth surfaces in the drying section, a tissue web is produced with very high bulk levels and with structural properties very similar to the structural properties of tissue webs that are dried solely with TAD dryers. The tissue web is pre-dried to a relatively high dry solids content before the final drying of the web, which means that the imprinted structure of the web will not be impaired when it is conveyed to a drying cylinder such as a Yankee dryer. At the same time, the energy demand is decreased in comparison with the energy demand for TAD drying, and the investment cost and space requirement is lowered. The efficient drying in the pre-drying section, ensured by the press nip with hot pressing, makes it possible to increase the speed of the tissue paper machine. Alternatively, smaller-diameter drying cylinders can be used in the final drying section; in this case of a TAD cylinder used in the final drying section, this means that smaller air flows are required. When the present invention is applied to the reconstruction of an existing papermaking machine, the capacity of the machine may be increased without requiring any extra space, and also the efficiency and reliability of the machine can be improved.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
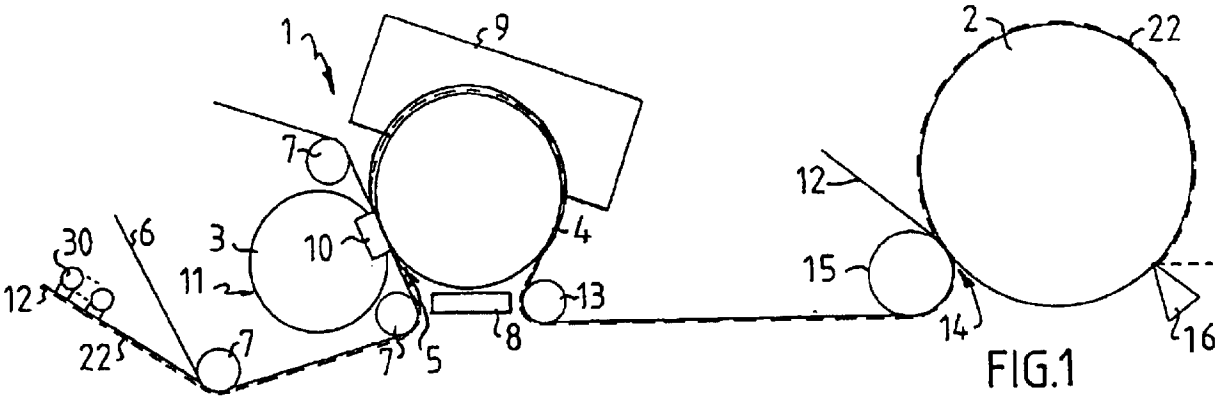
FIG. 1 is a schematic illustration of a first embodiment of the invention, comprising a press with the web wrapped around the counter roll, followed by a Yankee dryer.

In the embodiment shown in FIG. 1, a pre-drying section includes a hot press, which is generally denoted with the reference numeral 1, and a final drying section with a drying cylinder 2, which in this first embodiment is a Yankee dryer. The hot press 1 comprises a first roll 3, a counter roll 4, which together with the first roll 3 forms a press nip 5, and an endless papermaking machinery fabric 12, which is in direct contact with the web 22. The fabric 12 has the ability to receive water from the web in liquid phase or in gas phase.

The pre-dryer also preferably includes a vacuum device 30 that sucks the web onto, and partially into, the permeable coarse open structure of the fabric 12 at a location prior to the press 1. Accordingly, the web 22 is arranged on an opposite side of the fabric 12 from the vacuum device 30.

The counter roll 4 is made of a solid cylindrical body, provided with shaft pivots (not shown), for rotatable journalling in bearings (not shown) by a motor (not shown). The counter roll 4 is provided with a movable (e.g., oscillating) or stationary external heating element 8, which heating element is arranged to heat a region of the exterior cylindrical surface of the roll 4 just prior to the entry of that surface region into the press nip 5. The heating may be effected by induction heating, heating by gas burner, or other means known per se in impulse drying. The web 22 is arranged to wrap a substantial part of the circumference of the counter roll 4, thereby additionally drying the web on the hot surface of the roll after the press nip 5. A ventilation hood 9 is arranged to ventilate at least a part of the surface of the counter roll 4 at a location where the web is carried by the roll. The web will release readily from the surface of the counter roll at high temperatures; a release agent can be used to control the release process. The release of the web from the counter roll surface is also facilitated by the web being relatively firmly held by the mesh structure of the fabric 12. If necessary, air knives or the like (not shown) may be arranged to aid in the releasing of the web from the roll surface. If needed, the shell surface of the counter roll 4 may be cleaned by a doctor blade, a brush (preferably a metal brush), or by air knives (not shown).

The impulse drying in the heated press nip 5 may result in beneficial effects on the bulk of the web. Although not wishing to be bound by theory, it is thought that this is caused by the sudden expansion of flash steam when the web leaves the high-pressure nip. Thereby, there is attained an advantageous increase in bulk/volume and softness of the web.

Optionally, the temperature of the web 22 may be increased before the press nip 5 by one or more steam blow boxes (not shown) arranged on the free side of the web. Pre-heating of the wet web gives the water a lower viscosity, which facilitates the pressing of the water from the web in the press nip 5.

The shell surface of the counter roll 4 is preferably, but not necessarily, provided with an imprinting pattern, whereby the web 22 will be imprinted on the side thereof that faces the shell of the counter roll 4. Since the fabric 12 is provided with an imprinting pattern, the web will, in this case, be imprinted on both sides. In addition to the advantage of having the web imprinted on both sides, which increases its bulk and softness, the pattern of the shell surface of the counter roll 4 leads to the web essentially only being compressed by the press nip 5 in the parts of the web that are affected by the elevated parts of the imprinting pattern, i.e., the parts between the depressions of the pattern. The intermediate parts that correspond to the depressions of the pattern are relatively unaffected. In these parts, the tissue web will be allowed to expand by the steam in the depressions, giving a tissue of high bulk. The web is thereby provided with an imprinting pattern, consisting of parts that are pressed together and other parts that are not pressed together, corresponding to the pattern of the surface of the roll. Even if the shell surface of the counter roll 4 is smooth, a similar effect will be achieved by virtue of the open mesh structure of the fabric.

In the embodiment of FIG. 1, the hot press 1 is a shoe press with an extended press nip 5, the first roll 3 being a shoe press roll having a press shoe 10. The shell of the first roll 3 thereby consists, as is conventional for a shoe press roll, of an impermeable, flexible jacket 11. The press shoe 10 has a concave surface (denoted with the reference numeral 23 in FIG. 6) to follow the convex surface of the counter roll 4, whereby the extended nip 5 is formed. The flexible jacket 11 of the first roll 3 runs through the press nip 5, in sliding contact with the concave surface of the press shoe 10. As an alternative, a press belt may be substituted for the flexible jacket 11 and may run in a loop about a plurality of guide rolls (not shown), the press shoe being mounted in the loop.

The clothing 6 of the shoe hot press 1 is arranged to run in a loop around a plurality of guide rolls 7 and through the extended nip 5. The web 22 is carried by the fabric 12 and is led together with the clothing 6 to the press nip 5. The web is separated, together with the fabric, from the clothing after the press nip, in order to lie on the surface of the counter roll 4 as described above. Preferably, the clothing 6 consists of a press felt, but alternatively the clothing can be a permeable belt having through apertures, and possibly depressions between the apertures, or an impermeable belt with depressions of suitable depth, shape and extension. The apertures and depressions are arranged to receive liquid and to carry it away from the web and out of the press nip 5. As another alternative, a suction device or any other known means may be used for carrying and withdrawing the moisture from the press nip.

Instead of or in addition to the permeable or impermeable belt 6, the pre-dryer also includes a permeable imprinting fabric 12 to carry the web at least through the pre-drying section. The fabric is preferably made of a synthetic and/or metal material and has an open coarse structure of about 35–50 mesh, both in the machine direction and in the cross direction.

The illustrated hot press 1 with a press shoe 10 is the preferred embodiment, but alternatively other types of hot press devices, such as a conventional roll press having a cylindrical press roll that cooperates with the hot counter roll 4 to form a press nip, may be used in the invention.

Downstream of the hot press 1, after the web 22 has been released from the surface of the counter roll 4, the web, and preferably also the fabric 12, is led, optionally via one or more guide rolls 13, to a drying cylinder 2 or other drying equipment, for final drying. In the first embodiment of FIG. 1, the drying cylinder 2 is a Yankee dryer. The web 22 is led into a transfer nip 14 between the drying cylinder 2 and a cylindrical transfer roll 15. The linear load of the transfer nip 14 preferably is very low. It is essentially only enough to transfer the web onto the drying cylinder. The web follows the Yankee dryer 2 around a greater part of its circumference, and is thereby dried by the warm shell surface thereof. The Yankee dryer is of a conventional type, including a hood and other components (not shown), as known in the art. However, the Yankee dryer 2 may have a somewhat smaller diameter than a conventional Yankee dryer. When the drying is completed, the web may be creped off from the shell surface of the dryer with the aid of a creping doctor 16. Alternatively, it may be led away without being creped.

If needed, the Yankee dryer may be followed by a light calender for improving a tactile feel of the web, or by other drying devices such as a through-air drying cylinder (TAD cylinder) or the like.

Figure 2:
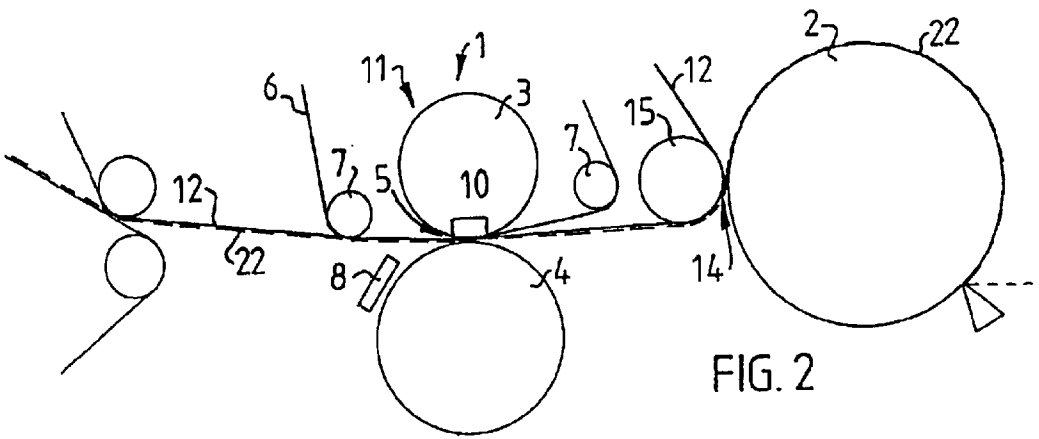
FIG. 2 is a schematic illustration of a second embodiment of the invention, comprising a press without web wrap around the counter roll, followed by a Yankee dryer.

In FIG. 2, there is shown a second embodiment of the invention, comprising a hot press 1 without web wrap around the counter roll 4, followed by a Yankee dryer 2. In this embodiment, the web passes through the nip between the first roll 3, which may be of shoe press type with an extended nip, and the heated counter roll 4. The web 22 is thereafter conveyed from the nip 5 to the Yankee dryer 2 by the fabric 12, without being carried around the circumference of the counter roll 4.

The web 22 is released from the roll 4 of the hot press 1, essentially directly after the press nip 5, by air knives or the like. The external heating element 8 may be arranged to heat the surface of the counter roll 4 at a location about 30°–300° prior the press nip. Accordingly, it may also be arranged in the vicinity of the outlet from the press nip, which is possible since the heat loss from the surface of the counter roll is relatively small before it comes in contact with the wet web in the press nip 5. In other respects, the second embodiment is generally similar to the one shown in FIG. 1.

Figure 3:
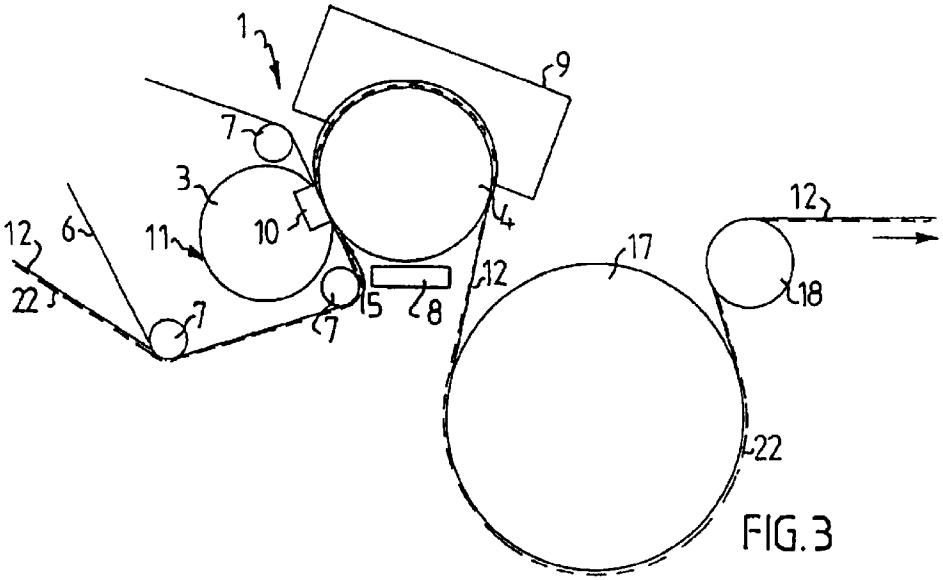
FIG. 3 is a schematic illustration of a third embodiment of the invention, comprising a press with the web wrapped around the counter roll, followed by a TAD cylinder with inward air flow.

In FIG. 3, a third embodiment of the invention is shown, comprising a hot press 1 with the web wrapped around the counter roll 4, followed by a thermal through-air drying cylinder (TAD cylinder) 17. The pre-drying section, comprising the hot press 1, is of the same configuration as the pre-drying section of FIG. 1. From the hot press 1, the web 22 is led, optionally via one or more guide rolls (not shown), on the fabric 12 to the drying cylinder 17. The web is arranged to be carried around a substantial part of the circumference of the drying cylinder 17, with the fabric 12, which is permeable, against the outer surface of the drying cylinder and the web supported on the outer surface of the fabric. The drying cylinder 17 is operable, via a hood (not shown), to draw air of temperatures up to 220° C. and velocities of about 5–10 m/s through the web, the fabric 12, and the shell surface of the cylinder, i.e. with an inward air flow, whereafter the air flow is discharged from the interior of the cylinder through one end thereof and is recirculated with the aid of a circulation fan. Thus, the web is dried by the through-flowing air. The web is finally dried on the TAD cylinder 17, and is then conveyed by the fabric 12, via one or more guide rolls 18, to a reel (not shown) for winding into a tissue paper roll. Alternatively, the web can be conveyed after the TAD cylinder to other drying devices, such as a Yankee dryer or the like, for additional drying.

Figure 4:
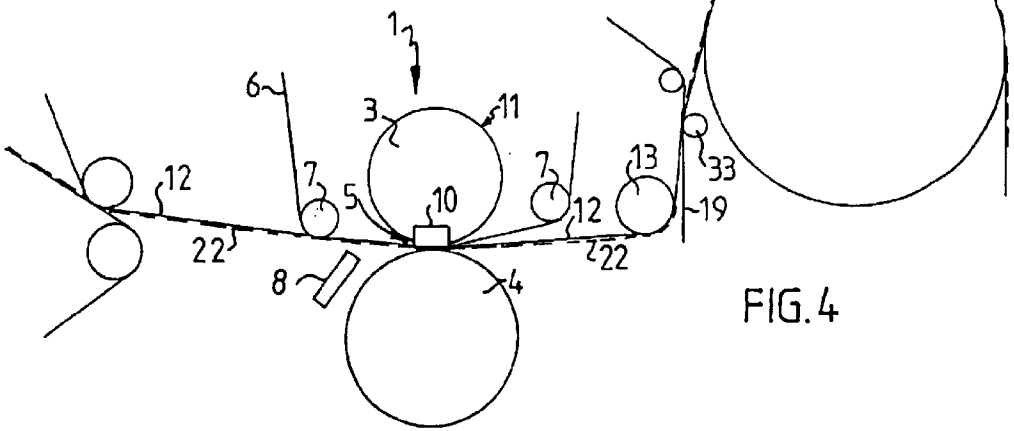
FIG. 4 is a schematic illustration of a fourth embodiment of the invention, comprising a press without web wrap around the counter roll, followed by a TAD cylinder with inward air flow.

In FIG. 4, there is shown a fourth embodiment of the invention, comprising a hot press 1 without web wrap around the counter roll 4. The hot press 1 is of the same type as the one shown in FIG. 2. After the hot press 1, the web 22 is optionally transferred from the fabric 12 to a second fabric 19, which here is a TAD fabric, via one or more pick-up devices 33, and further to a drying cylinder 17. In this embodiment, the drying cylinder 17 is a TAD cylinder of the same configuration as the one shown in FIG. 3. After the TAD cylinder the web can be conveyed to further drying devices, such as a Yankee dryer (not shown), or can be conveyed to a reel (not shown) for winding.

Figure 5:
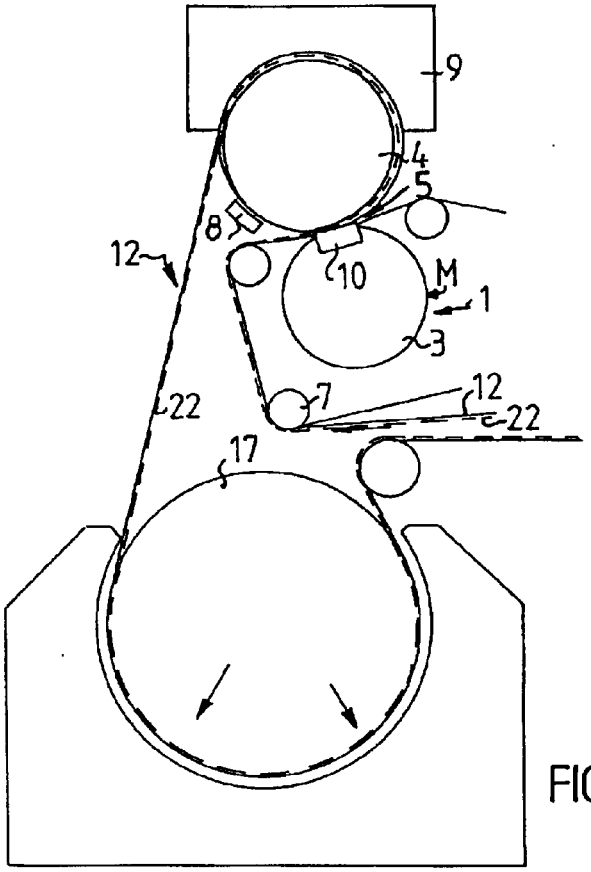
FIG. 5 is a schematic illustration of a fifth embodiment of the invention, comprising a press with the web wrapped around the counter roll, followed by a TAD cylinder with outward air flow.

FIG. 5 depicts a fifth embodiment of the invention, comprising a hot press 1 with the web wrapped around the counter roll 4, as in FIG. 1. After the hot press 1, the web 22 is conveyed, optionally via one or more guide rolls (not shown), to a TAD cylinder 17. In this embodiment, the TAD cylinder 17 is arranged with outward air flow from the interior of the cylinder through the web and the fabric. The web is thereby arranged to be carried around a substantial part of the circumference of the shell surface of the cylinder, between the permeable fabric 12 and the cylinder 17.

Figure 6:
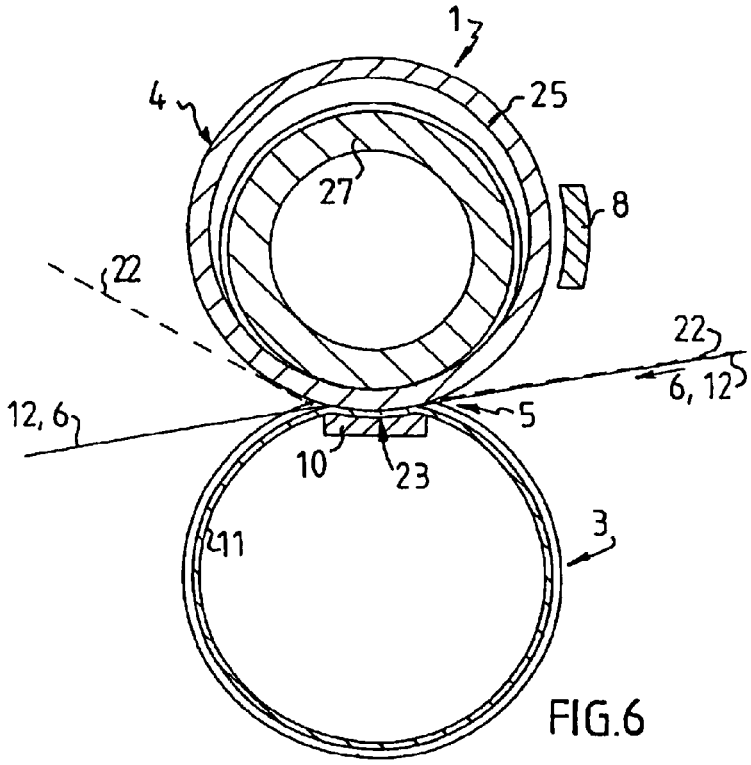
FIG. 6 shows a preferred embodiment of a counter roll in accordance with the present invention.

FIG. 6 shows a preferred embodiment in which the counter roll 4 is provided with a heatable, preferably exchangeable, sleeve 25, which is arranged to surround a roll body 27, preferably to loosely surround the roll body, in order to allow free expansion of the sleeve 25 in relation to the roll body 27, whereby undesired stresses are avoided. The sleeve 25 is movable and is arranged to continuously transmit heat to the web 22 when the web passes through the press nip 5. The sleeve 25 is heated from the outside by the external heating element 8. The sleeve 25 is preferably cylindrical and surrounds at least the axial part of the cylindrical roll body 27 that is active in the press nip 5. The sleeve 25 is free from mechanical, adhesive, or any other type of permanent, fixing connection to the roll body 27 that would prevent a free expansion of the sleeve 25, axially and/or radially, in relation to the cylindrical roll body 27.

The roll body 27 is arranged to press against the sleeve 25 at a location within the zone of the press nip 5, i.e., within the zone of the press shoe 10. The pressure between the sleeve 25 and the roll body 27 is high enough for the sleeve to be rotated by the roll body with the same peripheral speed at the location of contact therebetween. The sleeve 25 is arranged to rotate about its own center axis, which is eccentric in relation to the axis of rotation of the roll body 27. The sleeve 25 may be rigid and stable in shape, or flexible and thus not stable in shape. Generally, if it is rigid, it has a wall thickness of 5–100 mm, preferably 15–40 mm. By making the wall thickness of the sleeve 25 thick enough, the shell surface of the sleeve can be treated as the surface of a conventional press roll, whereby it may be cleaned by a cleaning means, such as a doctor blade, a brush (preferably a metal brush), or by air knives (not shown). If the sleeve 25 is flexible, it may be a soft, flexible cylinder, with a wall thickness of 0.4–5.0 mm, preferably 0.8–2.3 mm. When the sleeve 25 is flexible, a doctor blade for cleaning may be arranged at a suitable location so that the sleeve 25 is bent towards the roll body 27, which will act as a support.

In accordance with yet another embodiment, the sleeve may also be permeable, which decreases the risk of the web sticking to the shell surface of the sleeve. The shell surface of the sleeve may be provided with through apertures and/or depressions, which constitute an imprinting pattern for the web. The pattern of the surface preferably is of the same configuration and dimensions as has been previously described in connection with the counter roll. The releasing of the web may also be facilitated by using air knives (not shown), for directing an intense air flow on the web, directly or through the sleeve.

The type of hot press 1 shown in FIG. 6 may be used in connection with any of the embodiments shown above.

Accordingly, although not shown, it may also be used with the web wrapped around the sleeve 25, in the same way as the web is wrapped around the counter roll 4 in FIGS. 1, 3 and 5.

In the embodiments shown in FIG. 1 and 2, the tissue web will be given good properties, such as bulk and structure, in the pre-drying section, at the same time as it is pre-dried to such an extent that the properties not will be impaired by the final drying, even though a conventional Yankee cylinder is used for the final drying. Thus, the web will exhibit qualities that are comparable to the qualities of a TAD-dried web, without using TAD drying.

The same is true for the embodiments shown in FIGS. 3, 4 and 5, although a TAD cylinder is used. The TAD cylinder, however, may be smaller than what usually is used for TAD cylinders, and may use smaller air flows than what is conventional.

In another embodiment of the invention, the heating of the counter roll is accomplished using both external heating and internal heating. Thus, an internally heated counter roll can be combined with an external heater. The internal heating arrangement preferably heats the shell over substantially its entire length and circumference; that is, rather than being confined to a small angular sector of the shell, the internal heating arrangement preferably is distributed over the full circumference. This provides a more uniform heating of the shell relative to heating only a sector of the shell with an external or internal heater. Preferably, the internal heating arrangement accomplishes up to about 25 percent of the total heating of the shell, i.e., it is responsible for up to about 25 percent of the overall temperature rise of the shell's exterior surface. It has been found that the combination of internal and external heating is particularly efficient and yields good spatial uniformity of heating.

Figure 7A:
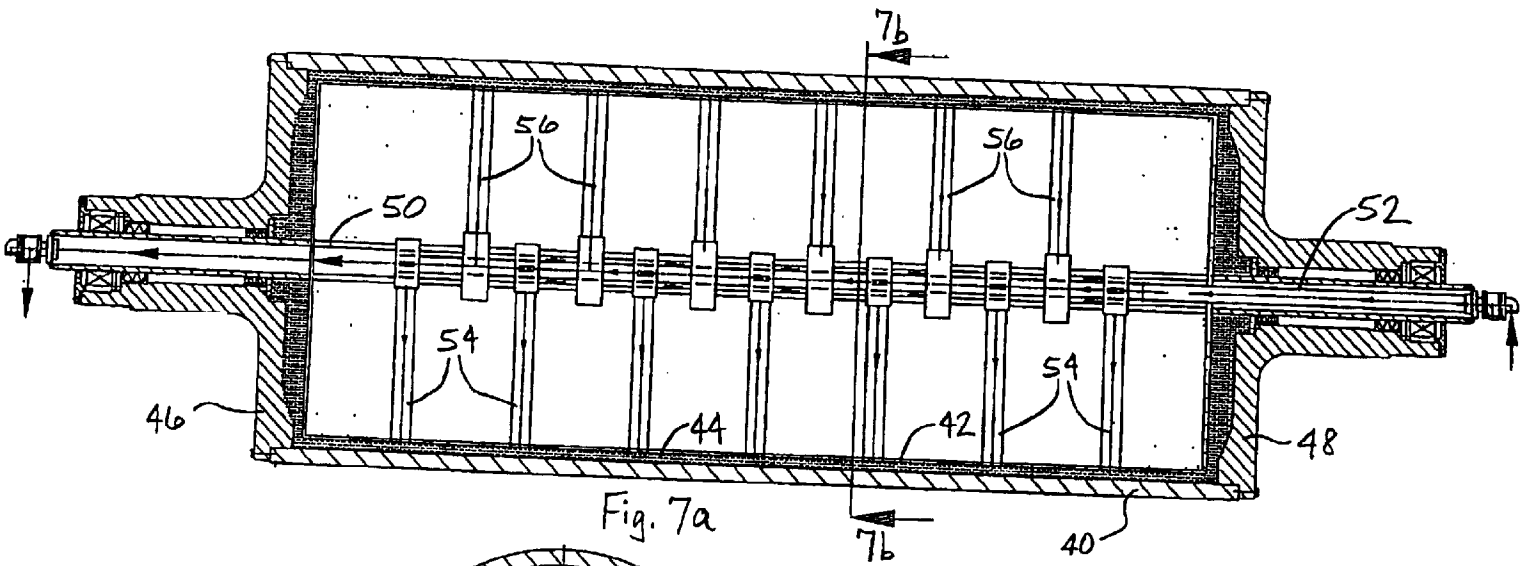
FIG. 7*a* is a sectioned side view of a fluid-heated counter roll for use in the pre-dryer in accordance with the present invention.
Figure 7B:
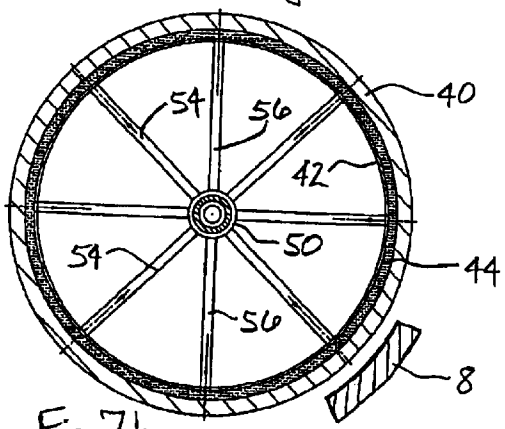
FIG. 7*b* is a sectioned end view of the roll of FIG. 7*a*.

The internally heated counter roll can be of various types. One suitable type circulates heated fluid through fluid-carrying members proximate the inner surface of the roll shell as shown diagrammatically in FIGS. 7*a* and 7*b*. The type of roll depicted in FIGS. 7*a* and 7*b* is described in co-pending commonly assigned U.S. patent application Ser. No. 10/104,265 filed Mar. 22, 2002 and entitled "Thermal Roll for Papermaking with a Fluid Circulation System and Method Therefor", which is incorporated herein by reference. The roll includes a rotatable outer shell 40 and a stationary inner shell 42 mounted coaxially within the outer shell 40 and of smaller diameter than the outer shell so as to form an annular space 44 between the shells. The rotatable outer shell 40 is affixed to opposite roll heads 46, 48 at opposite ends of the shell, and the heads are suitably supported by bearings mounted about a pipe 50 that extends through the roll head 48 along the axis of the shells 40, 42 and out through the opposite roll head 46. A main fluid supply pipe 52 extends up the middle of the pipe 50 and connects to a plurality of generally radially extending supply pipes 54 spaced circumferentially and axially along the roll; the radial supply pipes 54 carry fluid into the annular space 44 between the shells 40, 42. The fluid is evacuated from the space 44 through a plurality of generally radial evacuation pipes 56 that are likewise spaced axially and radially along the shell and connect to the pipe 50 so as to evacuate fluid into an annular space between the pipe 50 and the main supply pipe 52. The pipe 50 then evacuates this fluid out through the roll head 46. Thus, in this embodiment, the fluid is supplied through one end of the roll and evacuated from the opposite end. In other embodiments (not shown herein, but shown and described in the aforementioned co-pending application), the fluid can be supplied into and evacuated out the same roll end. The circulated fluid is heated by a suitable heater (not shown) and is circulated by a pump (not shown). FIG. 7*b* also shows an external heater 8 for heating the exterior surface of the roll shell 40. Thus, the shell is heated both from the inside and from the outside.

Figure 8:
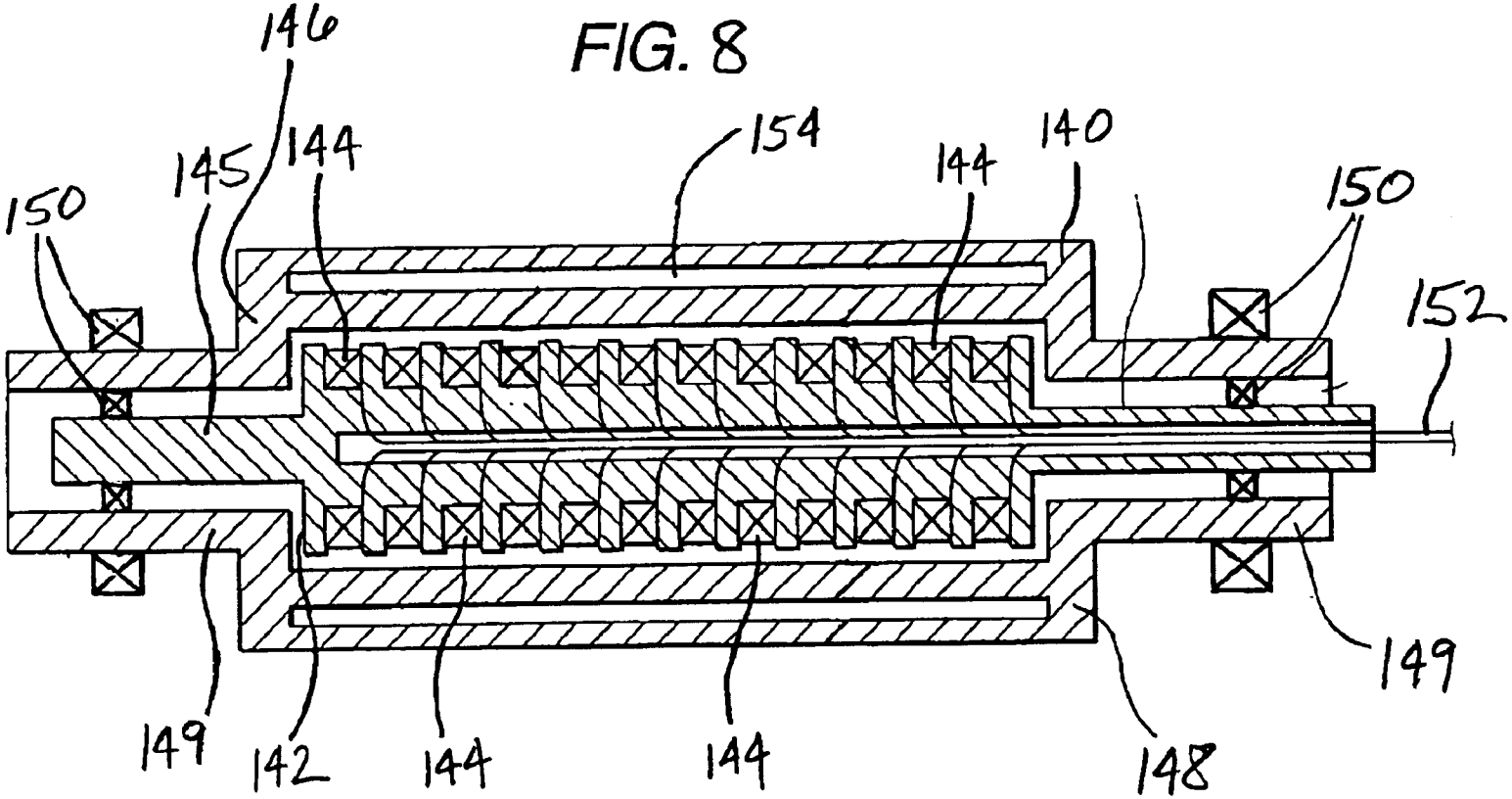
FIG. 8 is a sectioned end view of an induction-heated counter roll for use in the pre-dryer in accordance with the invention.

The internally heated roll alternatively can employ induction heating of the shell as schematically shown in FIG. 8. The induction-heated roll includes a hollow rotatable shell 140 and a stationary iron core 142 disposed coaxially inside the shell. Induction coils 144 are wound about the core 142; twelve coils are shown, but the number of coils can be varied as desired. A central shaft 145 is joined to the core 142 and extends from opposite ends thereof. The shell 140 includes roll heads 146 and 148 respectively joined to opposite ends of the shell; each roll head includes a hollow cylindrical portion 149 that coaxially receives a corresponding end portion of the shaft 145, and bearings 150 support the hollow cylindrical portions 149 of the roll heads and the end portions of the shaft 145. One end portion of the shaft 145 is hollow and receives the induction coil leads 152 that supply current to the induction coils 144. The coils thereby heat the shell 140. If desired, the shell can include internal passages 154 filled with a medium such as a two-phase heating medium. Those skilled in the art may recognize that the roll is of the type manufactured by Tokuden Co., Ltd. of Kyoto, Japan, and described in U.S. Pat. No. 6,340,811. Other types of induction-heated rolls could be used instead.

In all embodiments of the invention, it is advantageous for the outer surface of the counter roll 4 to have good release characteristics so that the dried web is readily released from the surface. This can be accomplished by coating the roll surface with a low-friction material such as PTFE, a ceramic material, or the like. A doctor blade (not shown) can also be used to aid in removing the web from the counter roll surface.

A paper product made in accordance with the method and apparatus of the invention advantageously has a basis weight of about 15 to 50 g/m$^2$ and a caliper of about 200 to 400 micrometers. By comparison, a conventionally manufactured tissue web dried on a Yankee dryer typically has a basis weight of about 10 to 50 g/m$^2$ and a caliper of about 100 to 150 micrometers; a TAD-dried tissue web typically has a basis weight of about 15 to 50 g/m$^2$ and caliper of about 250 to 400 micrometers.

Many modifications and other embodiments of the invention will come to mind to one skilled in the art to which this invention pertains having the benefit of the teachings presented in the foregoing descriptions and the associated drawings. For example, the TAD cylinder of FIG. 5 may be combined with a press without web wrap around the shell surface of the counter roll. Further, the final dryer does not have to include a Yankee dryer and/or a TAD cylinder but may include a flat through-air drying system, or the drying system marketed under the trademark CONDEBELT by Valmet Corporation, and also infrared heaters may be used. Additionally, while fluid-heated and induction-heated counter rolls have been described, it will be recognized that other types of internal heating devices could be used, such as gas-fired heaters, infrared heaters, and the like. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A drying section for drying a web in a papermaking machine, the drying section comprising a pre-drying section and a final drying section, wherein the pre-drying section includes a hot press comprising:

a first press member and a rotatable counter roll in engagement with each other so as to form a nip therebetween through which the web passes, the counter roll comprising a hollow outer shell having an exterior surface and defining an internal space therein;

an imprinting fabric arranged in an endless loop, the imprinting fabric defining an imprinting surface for imprinting the web and being arranged to pass through the nip with one side of the web contacting the exterior surface of the shell and an opposite side of the web against the imprinting surface such that the web is imprinted, the imprinted web continuing to be supported on the imprinting fabric downstream of the hot press at least up to the final drying section; and a heating arrangement comprising an exterior heater arranged outside the shell proximate the exterior surface thereof and an internal heater arranged within the internal space for heating the shell, whereby the shell is heated both from inside and from outside and the heated shell heats the web passing through the nip.

2. The drying section of claim 1, wherein the exterior surface of the shell is smooth.

3. The drying section of claim 1, wherein the shell defines an imprinting surface that contacts the web and imprints the side of the web in contact therewith.

4. The drying section of claim 1, wherein the imprinting fabric is arranged to maintain the web against the shell over a sector of the counter roll subtending an angle of about 90° to 300°.

5. The drying section of claim 4, further comprising a ventilation hood surrounding at least a portion of said sector of the counter roll.

6. The drying section of claim 1, wherein the first press member includes a press shoe forming an extended nip with the counter roll.

7. The drying section of claim 1, further comprising a clothing arranged in an endless loop such that the clothing passes through the nip with the imprinting fabric sandwiched between the clothing and the web and then separates from the imprinting fabric and the web downstream of the nip, the clothing being operable to carry water away from the web.

8. The drying section of claim 1, further comprising at least one suction device disposed upstream of the nip for suctioning the web against the imprinting surface of the imprinting fabric such that the web is made to conform to the imprinting surface.

9. The drying section of claim 1, wherein the final drying section includes a heated dryer roll, and wherein the imprinting fabric loop includes a guide roll that forms a nip with the heated dryer roll through which the imprinting fabric with the web supported thereon passes, the web being transferred from the imprinting fabric onto the heated dryer roll at the nip.

10. The drying section of claim 1, wherein the final drying section includes a rotary through-air dryer having a drying cylinder about which the imprinting fabric is wrapped so as to carry the web about the drying cylinder.

11. The drying section of claim 1, wherein the final drying section includes a rotary through-air dryer having a drying cylinder and further includes a drying fabric arranged in an endless loop so as to pass over the drying cylinder, the imprinting fabric loop being arranged to transfer the web from the imprinting fabric onto the drying fabric upstream of the drying cylinder, the drying fabric carrying the web about the drying cylinder.

12. The drying section of claim 1, wherein the internal heater comprises an arrangement of fluid-carrying members disposed proximate an inner surface of the shell for carrying a heated fluid so as to heat the shell.

13. The drying section of claim 1, wherein the internal heater comprises an induction heater.

14. A pre-dryer for pre-drying and imprinting a web in a papermaking machine, comprising:

a first press member and a rotatable counter roll in engagement with each other so as to form a nip therebetween through which the web passes, the counter roll comprising a hollow outer shell having an exterior surface and defining an internal space therein;

an imprinting fabric arranged in an endless loop, the imprinting fabric defining an imprinting surface for imprinting the web and being arranged to pass through the nip with one side of the web contacting the exterior surface of the shell and an opposite side of the web against the imprinting surface such that the web is imprinted, the imprinted web continuing to be supported on the imprinting fabric downstream of the nip; and a heating arrangement comprising an exterior heater arranged outside the shell proximate the exterior surface thereof and an internal heater arranged within the internal space for heating the shell, whereby the shell is heated both from inside and from outside and the heated shell heats the web passing through the nip.

15. The pre-dryer of claim 14, wherein the internal heater comprises one of an induction heater and a circulating fluid heater.

16. The pre-dryer of claim 14, wherein the imprinting fabric is arranged to maintain the web against the shell over a sector of the counter roll subtending an angle of about 90° to 300°.

17. The pre-dryer of claim 16, further comprising a ventilation hood surrounding at least a portion of said sector of the counter roll.

18. The pre-dryer of claim 14, further comprising a clothing arranged in an endless loop such that the clothing passes through the nip with the imprinting fabric sandwiched between the clothing and the web and then separates from the imprinting fabric and the web downstream of the nip, the clothing being operable to carry water away from the web.

19. The pre-dryer of claim 14, further comprising at least one suction device disposed upstream of the nip for suctioning the web against the imprinting surface of the imprinting fabric such that the web is made to conform to the imprinting surface.

20. A method for drying a web in a papermaking machine, the method comprising:

transporting the web and a permeable imprinting fabric having an imprinting surface through a nip between a first press member and a rotatable counter roll with one side of the web against the counter roll and an opposite side of the web against the imprinting surface, the counter roll comprising a hollow outer shell having a web-contacting exterior surface and defining an internal space therein;

heating the shell from both inside and outside thereof using an internal heater and an external heater to raise the temperature of the exterior surface of the shell such that the exterior surface of the shell contacts and heats the web at least in the nip so as to increase the dry solids content of the web and imprint the web;

carrying the web on the imprinting fabric from the nip at least up to a final drying section; and further drying the web in the final drying section.

21. The method of claim 20, wherein the imprinting fabric is arranged to maintain the web against the counter roll over a sector of the counter roll subtending an angle of about 90° to 300°.

22. The method of claim 20, wherein the final drying section includes a heated dryer roll, and wherein the imprinting fabric with the web supported thereon is passed through a nip between the heated dryer roll and a guide roll about which the imprinting fabric is looped, the web being transferred from the imprinting fabric onto the heated dryer roll at the nip.

23. The method of claim 20, wherein the final drying section includes a rotary through-air dryer having a drying cylinder, and wherein the imprinting fabric is wrapped about the drying cylinder so as to carry the web about the drying cylinder.

24. The method of claim 20, wherein the final drying section includes a rotary through-air dryer having a drying cylinder and further includes a drying fabric arranged in an endless loop so as to pass over the drying cylinder, the web being transferred from the imprinting fabric onto the drying fabric upstream of the drying cylinder, the drying fabric carrying the web about the drying cylinder.

25. The method of claim 20, wherein the counter roll surface is heated to a temperature of at least 150° C.

26. The method of claim 20, wherein the counter roll surface is heated to a temperature between 200° C. and 300° C.

27. An imprinted tissue paper made by the method of claim 20, the tissue paper having a basis weight of about 15 to 50 g/m$^2$ and a caliper of about 200 to 400 micrometers, the tissue paper having an imprinted structure that is substantially retained upon re-wetting of the tissue paper.

* * * * *